US008322688B2

(12) United States Patent
Hebert

(10) Patent No.: US 8,322,688 B2
(45) Date of Patent: Dec. 4, 2012

(54) LANDING JACK LIFT

(76) Inventor: William Hebert, Reno, NV (US)

( * ) Notice: Subject to any disclaimer, the term of this patent is extended or adjusted under 35 U.S.C. 154(b) by 119 days.

(21) Appl. No.: 12/717,945

(22) Filed: Mar. 4, 2010

(65) Prior Publication Data

US 2010/0224842 A1 Sep. 9, 2010

Related U.S. Application Data

(60) Provisional application No. 61/157,233, filed on Mar. 4, 2009.

(51) Int. Cl.
*B66F 3/00* (2006.01)

(52) U.S. Cl. ..... 254/131; 254/113; 254/120; 254/130

(58) Field of Classification Search ..... 254/113–140
See application file for complete search history.

(56) References Cited

U.S. PATENT DOCUMENTS

| | | | | |
|---|---|---|---|---|
| 343,341 | A * | 6/1886 | Robertson | 254/131 |
| 4,738,433 | A * | 4/1988 | Hoff | 254/30 |
| 6,109,593 | A * | 8/2000 | Craychee | 254/8 B |
| 6,170,803 | B1 * | 1/2001 | Liberfarb | 254/131 |
| 6,202,985 | B1 * | 3/2001 | Chong et al. | 254/131 |
| 6,302,375 | B1 * | 10/2001 | Heil et al. | 254/17 |
| 7,182,361 | B2 * | 2/2007 | Lewoczko | 280/293 |
| 7,658,369 | B2 * | 2/2010 | Baldwin | 254/30 |
| 2007/0096070 | A1 * | 5/2007 | Kobacker et al. | 254/131 |
| 2008/0107511 | A1 * | 5/2008 | Oberg | 414/445 |
| 2009/0159861 | A1 * | 6/2009 | Gray et al. | 254/131 |

* cited by examiner

*Primary Examiner* — Lee D Wilson
*Assistant Examiner* — Alvin Grant
(74) *Attorney, Agent, or Firm* — Patwrite LLC; Mark David Torche

(57) ABSTRACT

Referring to the figures, a landing jack lift 100 is shown having an upright lever portion 105 which is pivotally connected to a base plate 130. Base plate 130 allows landing jack lift 100 to be used in soft soil conditions and provides a stable support in use. A lifting arm 120 is pivotally connected to upright lever portion 105 using a pivot 150. Pivot 150 is a bolt, but other pivoting means may be used such as pins, rivets, etc. as is known in the art. A lifting plate 125 is provided to fit under a landing jack 165 attached to a trailer 160 to allow a user to move landing jack 165 without having to bend over or lie on the ground. Lifting plate 125 is pivotally mounted so the as the angle changes with respect to lifting arm 120, lifting plate 125 maintains level contact with landing jack 165. Additionally, lifting plate 125 telescopically fits within lifting arm 120 in order to allow a user to adjust the length.

4 Claims, 3 Drawing Sheets

LANDING JACK LIFT

CROSS REFERENCE TO RELATED APPLICATIONS

This application claims priority and herein incorporates by reference U.S. provisional patent application 61/157,233, filed Mar. 4, 2009.

BACKGROUND OF THE INVENTION

Landing jacks are very useful when setting up trailers, truck beds and other towable devices. Although they are useful, they often require the user to raise and lower them manually which means that the user has to bend over or even lay on the ground which is uncomfortable.

There is a need for a means for raising and lowering the landing jack without having to bend over to operate.

SUMMARY OF THE INVENTION

A landing jack lift has an upright lever portion which is pivotally attached to a base plate. A lifting arm is pivotally connected to the upright along the lower portion of the upright lever. A lifting plate is pivotally disposed on an end of the lifting arm and removably fits under a landing jack foot while in use. A pin pulling arm is pivotally disposed above the lifting arm on the upright lever portion and selectively retains the locking pin on the landing jack to allow the landing jack to move. The lifting arm is constrained to not pivot past around 90 degrees from the upright lever. In use the user is not required to bend over while raising and lowering the landing jack. A handle is provided on the upper portion of the upright lever to aid the user.

Other features and advantages of the instant invention will become apparent from the following description of the invention which refers to the accompanying drawings.

DETAILED DESCRIPTION OF THE INVENTION

Figure 1:
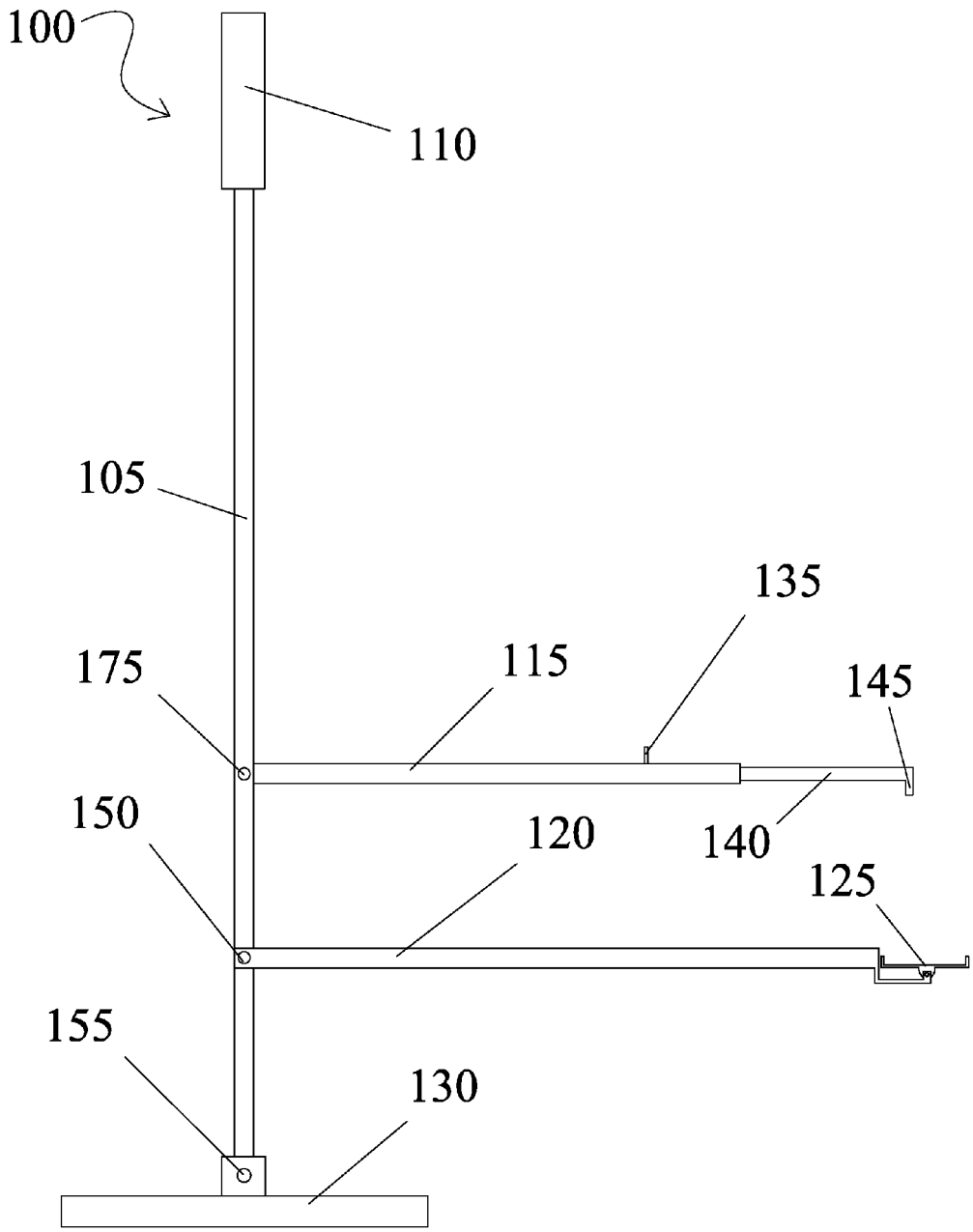
FIG. 1 is a side view of a landing jack lift according to an embodiment of the present invention.
Figure 2:
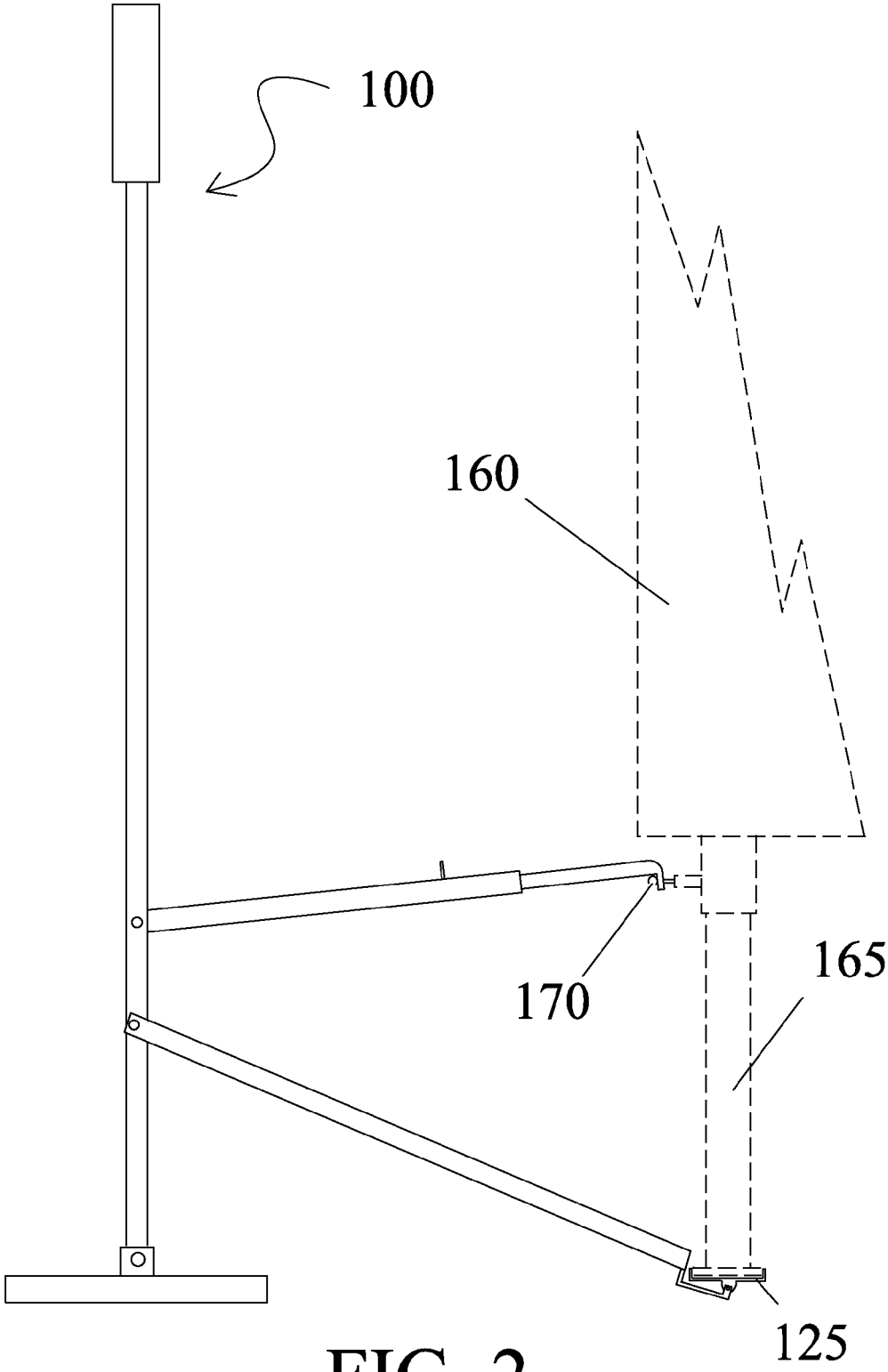
FIG. 2 is a side view of the landing jack lift shown in FIG. 1 with the landing jack in a down position.
Figure 3:
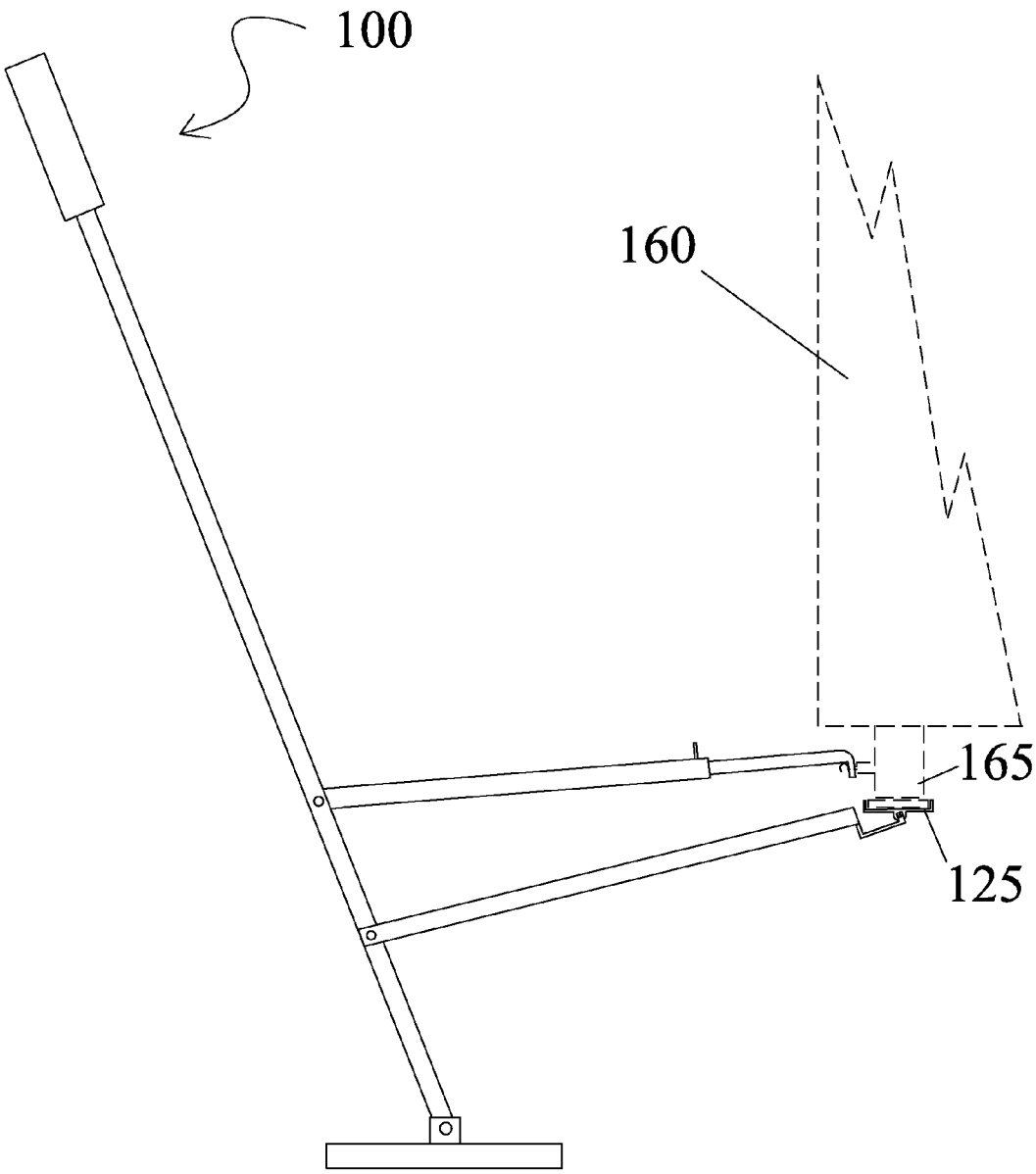
FIG. 3 is a side view of the landing jack lift shown in FIG. 1 with the landing jack in an up position.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to the figures, a landing jack lift 100 is shown having an upright lever portion 105 which is pivotally connected to a base plate 130. Base plate 130 allows landing jack lift 100 to be used in soft soil conditions and provides a stable support in use. A lifting arm 120 is pivotally connected to upright lever portion 105 using a pivot 150. Pivot 150 is a bolt, but other pivoting means may be used such as pins, rivets, etc. as is known in the art. A lifting plate 125 is provided to fit under a landing jack 165 to allow a user to move landing jack 165 without having to bend over or lie on the ground. Lifting plate 125 is pivotally mounted so the as the angle changes with respect to lifting arm 120, lifting plate 125 maintains level contact with landing jack 165. Additionally, lifting plate 125 telescopically fits within lifting arm 120 in order to allow a user to adjust the length.

Because landing jacks 165 have locking pin 170 to retain landing jack 165 in the selected position. Landing jack pin 170 needs to be disengaged when moving landing jack 165. A pin pulling arm 115 is pivotally connected to upright lever portion 105 to hold locking pin 170 in an open position while moving and then released to engage.

A locking pin catch 145 is disposed on an end of pin pulling arm 115 and has a clip edge to retain locking pin 170. Of course other shapes and means may be used as long as locking pin catch 145 selectively catches locking pin 170. Additionally locking pin catch is biased with a coil spring (not shown) to maintain a force on locking pin 170. Of course other biasing means may be used such a coil spring, etc. as long as locking pin 170 is held in an open position while moving landing jack 165.

A pin 135 is providing to move locking pin catch 145 and moves within a groove disposed along a top portion of pin pulling arm 115 and connects a pin pulling insert arm 140 that telescopically fits within pin pulling arm 115.

Although the instant invention has been described in relation to particular embodiments thereof, many other variations and modifications and other uses will become apparent to those skilled in the art.

What is claimed is:

1. A landing jack lift comprising:

an upright lever portion;

a base plate;

said upright lever portion being pivotally attached to said base plate;

a lifting arm pivotally disposed along a lower portion of said upright lever portion;

a pin pulling arm rotatably disposed on said upright lever portion and above said lifting arm;

a lifting plate pivotally disposed on an other end of said lifting arm wherein said lifting plate removably fits under a landing jack foot.

2. The landing jack lift according to claim 1 wherein said pin pulling arm has a locking pin holding means for selectively holding said locking pin in an unlocked position.

3. The landing jack lift according to claim 2 wherein said locking pin holding means comprises a spring biased holding clip.

4. The landing jack lift according to claim 1 further comprising a handle portion disposed along an upper end of said upright lever portion.

* * * * *